United States Patent [19]

Hwang

[11] Patent Number: 5,006,082

[45] Date of Patent: Apr. 9, 1991

[54] ACTUATING-DEVICE FOR SMALL-TYPE AIR-FEEDED WATER FLOATERS

[76] Inventor: Feng-Lin Hwang, No. 21, Pa Te Rd., Chi Tu District, Keelung City, Taiwan

[21] Appl. No.: 450,490

[22] Filed: Dec. 14, 1989

[51] Int. Cl.[5] ..... B63H 21/17

[52] U.S. Cl. ..... 440/6; 441/129; 248/640

[58] Field of Search ..... 440/6; 441/129; 248/640, 641, 642, 643

[56] References Cited

FOREIGN PATENT DOCUMENTS 2484356 12/1981 France ..... 440/6

637584 8/1983 Switzerland ..... 440/6

*Primary Examiner*—Sherman D. Basinger

*Assistant Examiner*—Thomas J. Brahan

*Attorney, Agent, or Firm*—Browdy and Neimark

[57] ABSTRACT

An actuating device for small inflatable rafts or articles comprising a jaw clip for securing the device to the article, the clip having a top plate with solar cells mounted on the jaw clip upper rim, and a housing mounted to the jaw clip bottom.

The solar cell plate produces electric currents via sunshine, and a rechargeable battery in the housing is charged with electricity. The battery serves as a power source for an air pump in the housing to generate air pressure to inflate a raft or other article. The battery also serves as the power source for a motor in the housing which drives propellers on its output shaft thereby providing a means to propel the inflated raft or article in the water.

1 Claim, 3 Drawing Sheets

ACTUATING-DEVICE FOR SMALL-TYPE AIR-FEEDED WATER FLOATERS

FIELD OF THE INVENTION

The present invention relates to an actuating device for use with small inflatable rafts or articles and particularly to a device which uses solar power to drive an air pump to inflate the raft or article and to also move the raft around in water.

BACKGROUND OF THE INVENTION

In the summer, various types of inflatable rafts and other articles are very popular with people who cannot swim or who wish to play in the water by the seashore or in swimming pools. These rafts strengthen the swimmers perception of safety in addition to enhancing their enjoyment in the water. However, inflation of the raft or article each time one swims has proved to be a deterrent to the use of such rafts. This invention is direction to assisting raft owners in the inflation of such articles and at the same time provide a means of propelling the raft while in the water.

OBJECT OF THE INVENTION

To solve the afore-said problem, the present invention provides an actuating device for inflatable rafts which uses solar power to supply a rechargeable battery which thereafter serves to drive an air pump for inflation of the raft thereby alleviating the owner from manual inflation.

A further object of this invention is to utilize the solar power to assist the raft owner in propelling the inflatable raft through the water.

SUMMARY OF THE INVENTION

An actuating device for small inflatable rafts or articles comprising a jaw clip which can be mounted on the inflatable raft or other floating article, a solar power plate mounted on the jaw clip upper rim, and a waterproof housing containing a battery, an air pump and motor mounted to bottom of the jaw clip. The solar cell plate produces electric current which charges the rechargeable battery which thereafter drives the air pump to inflate the raft or article. The motor with an output shaft extending through the housing and provided with propellers, is used to drive the propellers and move the raft through the water.

SPECIFIC DESCRIPTION

Figure 1:
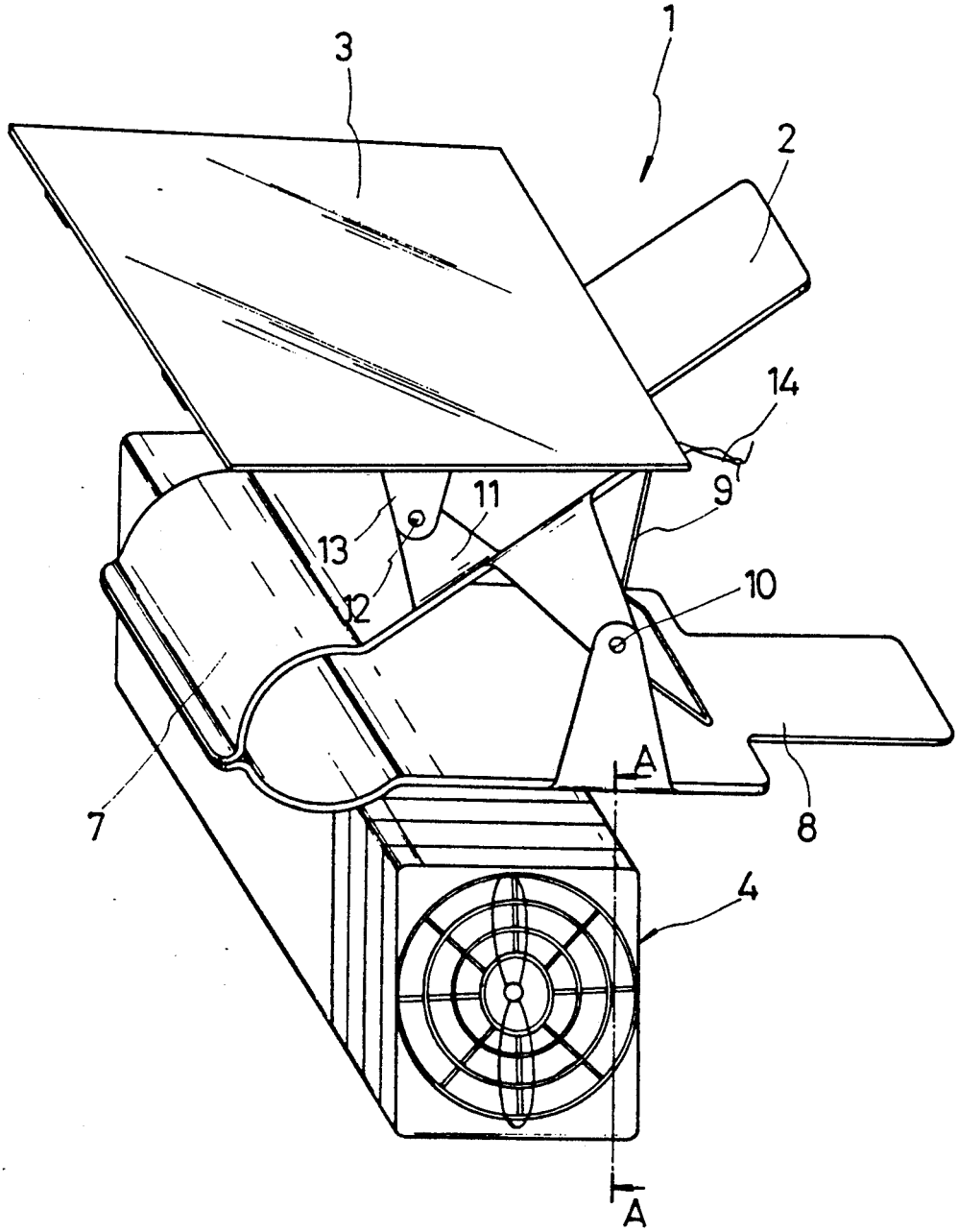
FIG. 1 is a perspective view of a preferred embodiment according to the invention.
Figure 2:
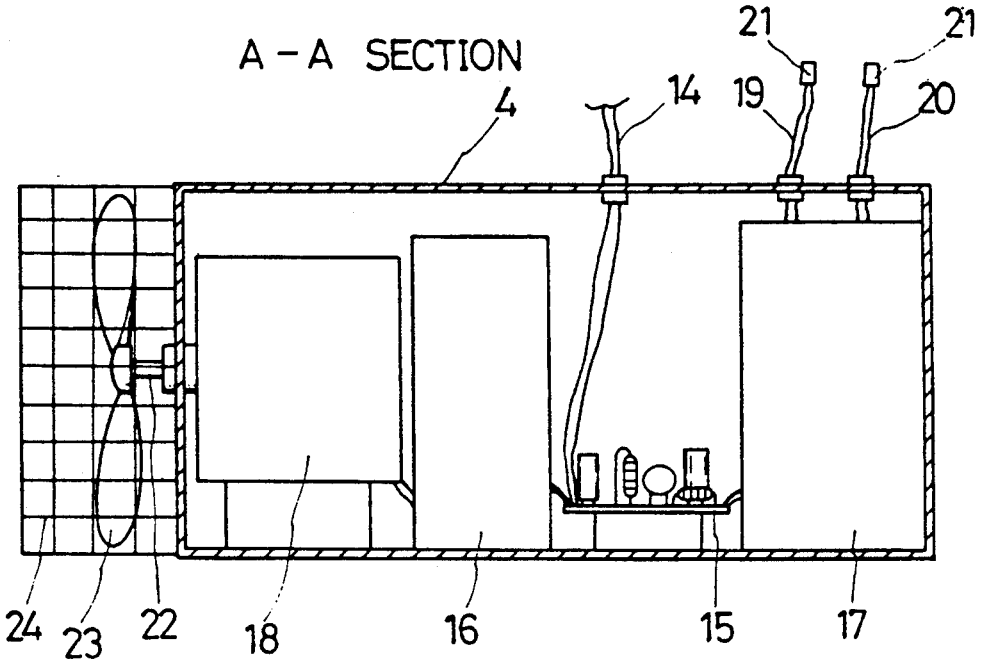
FIG. 2 is a sectional view through section A—A of FIG. 1.
Figure 3:
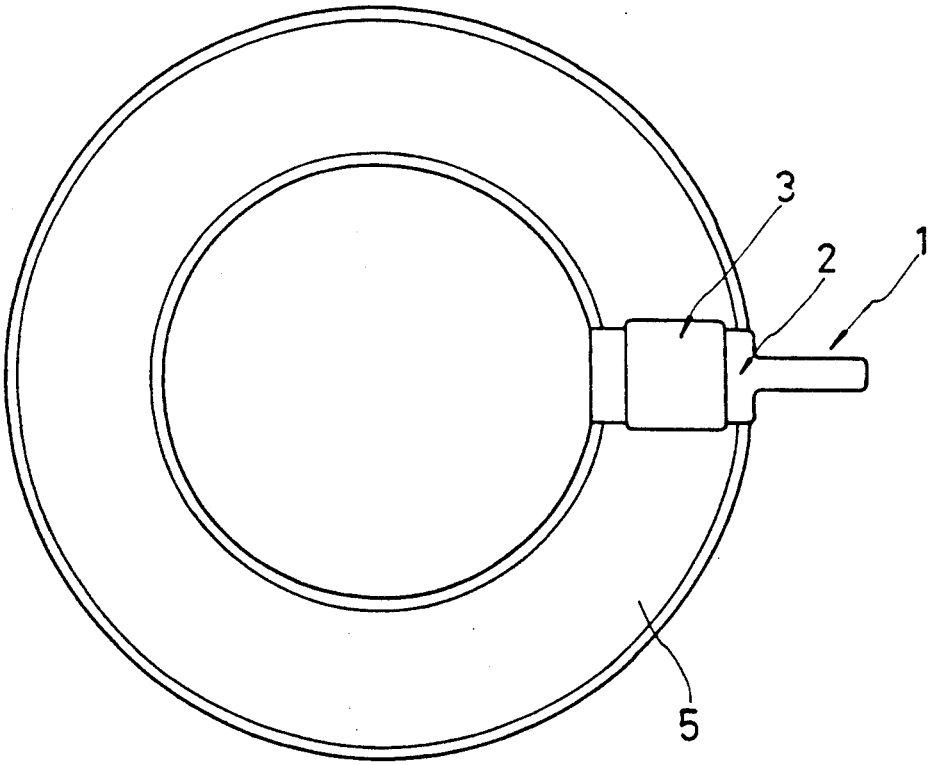
FIG. 3 is an example view, showing the invention in FIG. 1 fixedly mounting to an inflatable ring.
Figure 4:
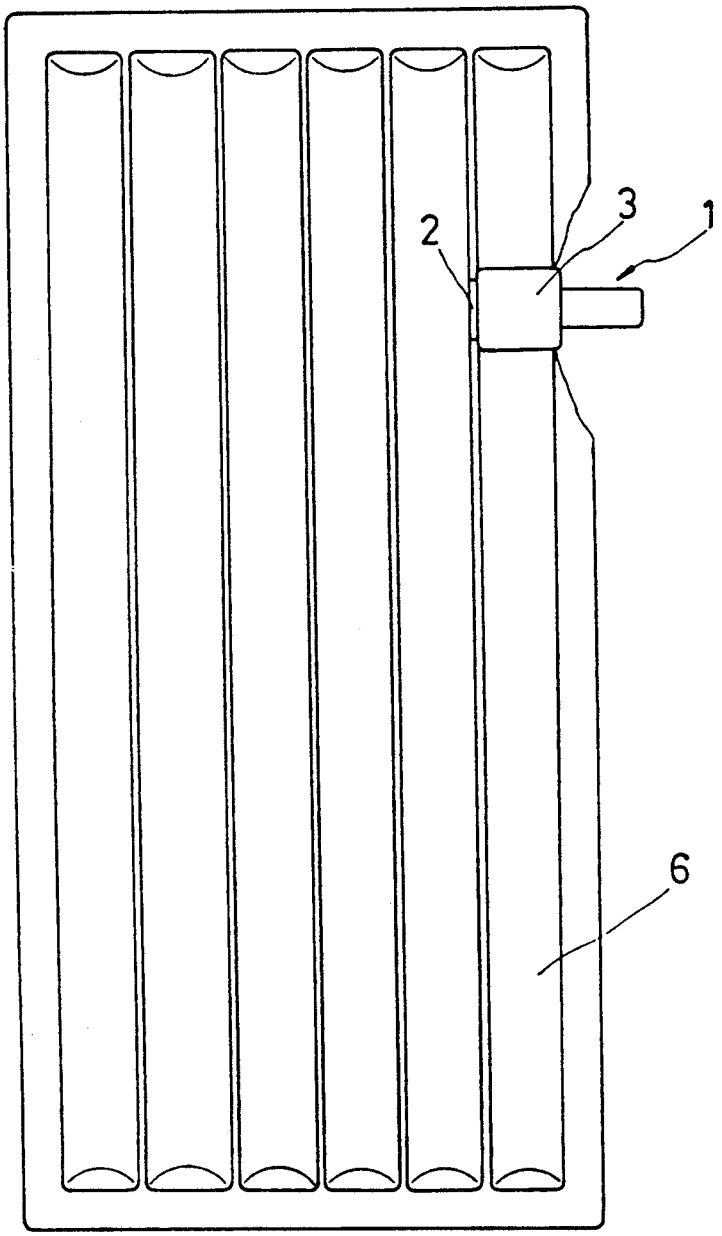
FIG. 4 is an example view, showing the invention in FIG. 1 fixedly mounting to an inflatable cushion.

As shown in FIGS. 1, 2, this inventive actuating device 1 comprises jaw clip 2, solar cell 3, and waterproofed housing 4. The jaw clip 2 and all the elements mounted thereto when mount onto inflatable ring 5 or inflatable cushion 6, or any other small inflatable article serves as a means to inflate the items to which it is mounted and further move these items in the water. Jaw clip 2 consists of an upper jaw piece 7, bottom jaw piece

8, twisted spring 9, and pivot pin 10, and is conventional, requiring no further description. The upper rim of upper jaw piece 7 is provided with connection base 11 to connect with top plate 13 which contains solar cells 3 by pivot pin 12, so the angle with respect to top plate 13 is adjustable to enable directing solar cell 3 toward sunlight in order to obtain the strongest possible photoelectric effects. Solar cells 3 are provided with a predetermined area for sunshine action, and both its positive and negative poles are connected with a waterproofed power lead 14 which is connected to the PC board 15 in housing 4 to electrically charge rechargeable battery 16. Housing 4 is sealed and waterproofed especially at points where various elements protrude through the housing as described further below. Housing 4 is mounted to the bottom of bottom jaw piece 8 and as previously suggested houses PC board 15 arranged with conventional charging circuits, rechargeable battery 16, air pump 17, and motor 18. Air pump 17 is provided with air inlet pipe 19 and air outlet pipe 20, both extending through water seals on housing 4 and with their ends set with sealing stoppers 21 to prevent water entry. The output shaft 22 of motor 18, extends out through a water seal on housing 4's rear side, is combined with propellers 23 and has its propellers' surrounded with mesh shield 24 to prevent damage to it or objects which would otherwise strike the propellers.

Before using the invention, battery 16 should be charged in advance with sufficient electricity power by solar cells 3. To begin use, sealing stoppers 21 at both ends of air outlet pipe 20 and air inlet pipe 19 have to be removed and the air outlet pipe end connected to the air cock of an inflatable article awaiting an air supply. Once the waterproofed air-feed switch (not shown) on housing 4, is thrown, the power source of air pump 17 operates to generate air-pressure that inflates various articles. During the process, rechargeable battery 16 can still be charged by means of solar cells 3. After the inflatable article is supplied with enough air, the floating article can be used for swimming or enjoyment in the water. Also, the device 1 can be securely mounted to a raft. After the switch of the motor is turned on propellers 23 propel the raft through the water.

The foregoing description of the specific embodiments will so fully reveal the general nature of the invention that others can, by applying current knowledge, readily modify and/or adapt it to various applications and other embodiments without departing from the generic concept, and therefore such adaptations and modifications are intended to be comprehended within the meaning and range of equivalents of the disclosed embodiments. It is to be understood that the phraseology or terminology herein is for the purpose of description and not of limitation.

I claim:

1. An actuating device for utilization with small inflatable floats for use in swimming pools and other bodies of water comprising:

a spring actuated jaw clip for attachment to an inflatable float comprising an upper jaw piece and a bottom jaw piece;

a top plate with solar cells mounted thereon;

said top plate pivotally connected to said upper jaw piece to permit adjustment for maximum exposure of said solar cells to sunlight;

a waterproof housing mounted on said bottom jaw piece comprising;

an air pump including an air outlet pipe protruding through said housing for inflating an inflatable float;

a motor having a drive shaft protruding through said housing, said shaft having a propeller mounted on an end thereof;

a rechargeable battery for actuating said air pump and said motor; and a PC board including first electrical connections protruding through said housing to said solar cells and other electrical connections from said PC board to said rechargeable battery, said air pump and said motor;

wherein said solar cells are adapted to charge said rechargeable battery and said battery is adapted to selectively drive said air pump and said motor for the purpose of inflating a float and propelling the float through water.

* * * * *